United States Patent [19]

Andersson

[11] Patent Number: 4,832,239

[45] Date of Patent: May 23, 1989

[54] CLOTHES-HANGER FOR SKIRTS OR TROUSERS

[75] Inventor: Ulf Andersson, Lidköping, Sweden

[73] Assignee: Karner & Co AB, Lidköping, Sweden

[21] Appl. No.: 117,938

[22] Filed: Nov. 5, 1987

Related U.S. Application Data

[63] Continuation of Ser. No. 916,362, Oct. 7, 1980, abandoned.

[30] Foreign Application Priority Data

Feb. 18, 1985 [SE] Sweden ..... 8500741

[51] Int. Cl.[4] ..... A47G 25/48; A47G 25/62

[52] U.S. Cl. ..... 223/95

[58] Field of Search ..... 223/63, 89, 90, 94, 223/95

[56] References Cited

U.S. PATENT DOCUMENTS

| | | | |
|---|---|---|---|
| 2,429,712 | 10/1947 | Fetter . | |
| 2,592,130 | 4/1952 | Erb et al. | 29/453 U X |
| 2,666,561 | 1/1954 | Welker | 223/94 |
| 2,832,130 | 4/1958 | Harvey | 29/453 |
| 2,998,904 | 9/1961 | Bellg | 223/95 |
| 3,024,954 | 3/1962 | Michlin . | |
| 4,391,395 | 7/1983 | Karner | 223/94 |

FOREIGN PATENT DOCUMENTS

| | | | |
|---|---|---|---|
| 2918368 | 10/1983 | Fed. Rep. of Germany . | |
| 3413973 | 12/1985 | Fed. Rep. of Germany | 223/94 |
| 3530380 | 4/1986 | Fed. Rep. of Germany | 223/95 |
| 316588 | 10/1969 | Sweden . | |
| 319172 | 3/1957 | Switzerland | 223/94 |
| 886171 | 1/1962 | United Kingdom | 223/89 |
| 962073 | 6/1964 | United Kingdom | 223/89 |
| 1189093 | 4/1970 | United Kingdom | 223/94 |
| 2120542 | 12/1983 | United Kingdom | 223/95 |

*Primary Examiner*—Robert R. Mackey

*Attorney, Agent, or Firm*—Finnegan, Henderson, Farabow, Garrett & Dunner

[57] ABSTRACT

A clothes-hanger for skirts or trousers has a central body (1) with two side walls (12) which define between them an axial channel (10) for accommodating at least one compression spring (7). The hanger further has an end piece (2) inserted in each end of the central body, and a hook (5) mounted on the central body. The displacement of the end piece by means of the compression spring out of the central body is restricted by stop means consisting of cooperating lugs (8, 11) at least one (8) of which is provided on the central body and at least one (11) of which is provided on the end piece. The lug (8) on the central body is provided on one of the side walls (12) thereof. When mounting the end piece in the central body, the lug on the end piece can freely pass the lug on the central body by urging it and, hence, the side wall (12) outwardly. After the lug on the end piece has passed the lug on the central body, the latter lug will snap in behind the former.

4 Claims, 2 Drawing Sheets

CLOTHES-HANGER FOR SKIRTS OR TROUSERS

This application is a continuation of application Ser. No. 916,362, filed Oct. 7, 1986, now abandoned.

The present invention relates to a clothes-hanger for skirts or trousers comprising a central body having two side walls which define between them an axial channel for accommodating at least one compression spring; an end piece inserted in each end of the central body, and a hook mounted on the central body, the displacement of the end piece by means of the compression spring out of the central body being restricted by stop means consisting of cooperating lugs, at least one of which is provided on the central body and at least one of which is provided on the end piece. More specifically, the invention relates to the design of said stop means.

Clothes-hangers for skirts or trousers of the above-described type suffer from the drawback that the stop means are not sufficiently strong and have relatively short life. A previously known hanger is designed with a resilient tongue mounted on the lower end portion of the central body, and with a stop lug mounted on the underside of the end piece. Such a hanger is disclosed in SE 316,588.

The drawback of this design is that the connection of the resilient tongue with the central body is weak and that the tongue risks being broken loose from the central body after the hanger has been used for some time. The problem is that such a connection cannot be made too sturdy, since this would impair the resilience of the tongue, and that, for connecting the tongue, one is restricted to the space between the side walls of the central body.

The object of the present invention is to overcome the problems inherent in previously known hangers, and especially to prevent damage to the stop means.

By providing fixed lugs on the side walls of the central body of the hanger, it is possible to obtain stronger and, thus, more reliable stop means. This is achieved in that the entire side wall yields outwardly when the end piece is inserted in the central body and, hence, the side wall takes up the forces of deformation which are produced when the end piece is inserted and which, in the prior art hanger mentioned above, were completely taken up by the hinge connection between the resilient tongue and the central body.

Figure 1:
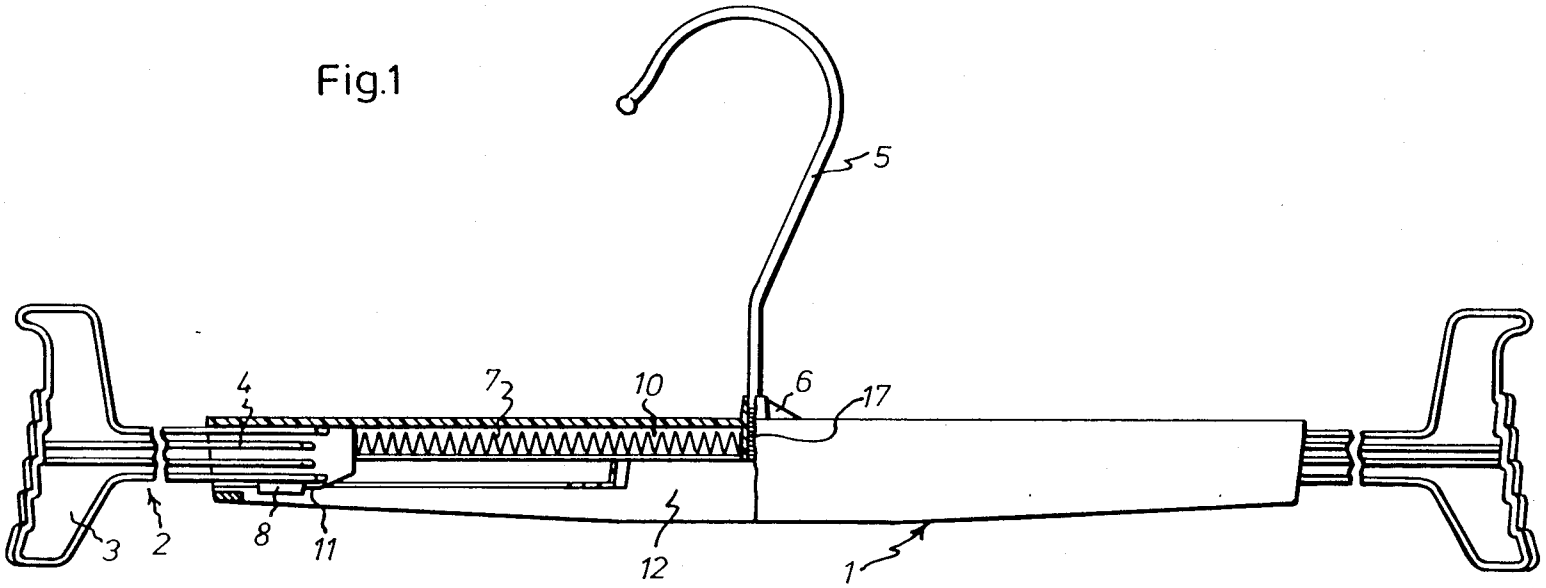
Figure 2A:
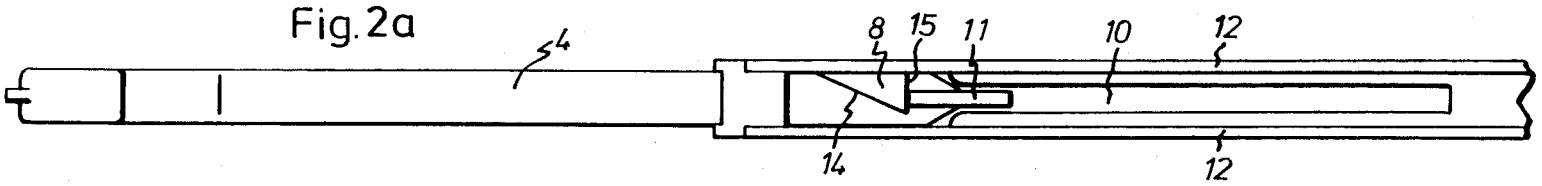
Figure 2B:
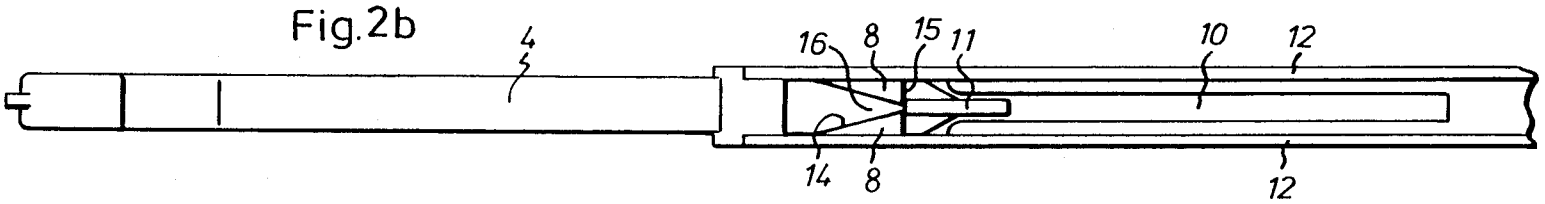
Figure 3:
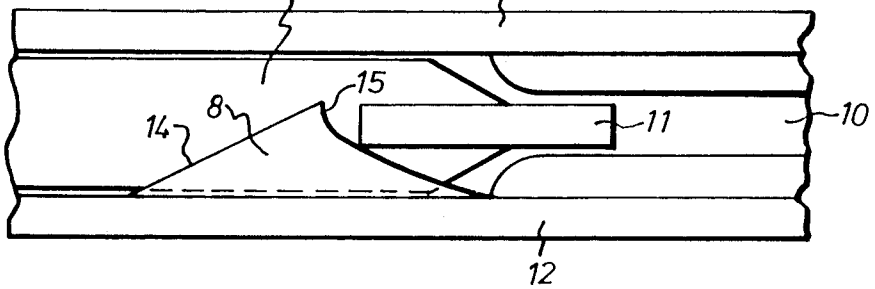

The invention will now be described in greater detail hereinbelow in some embodiments with reference to the accompanying drawings, in which:

FIG. 1 is a part sectional side view of a clothes-hanger for skirts or trousers according to the present invention;

FIGS. 2*a* and 2*b* illustrate from below part of the hanger according to the invention, with two different stop means; and FIG. 3 illustrates from below a further embodiment of the stop means.

Referring now to FIG. 1, there is shown a clothes-hanger according to the invention which consists of a central body 1 having two side walls 12 defining between them an axial channel 10 divided by a partition 17 which is provided in association with a socket 6 formed on the upper side of the central body. The suspension hook 5 of the hanger is mounted in the socket 6. A compression spring 7 is disposed in each half of the channel 10 which preferably is rectangular and adapted to receive the insertion shank 4 of an end piece 2 which also has a gripping shank 3. The end piece 2 is inserted in the central body to such an extent that the compression spring 7 is slightly compressed and biased. In order to prevent the end piece from being pressed out of the central body by the compression spring, there are thus required stop means determining the outer position of the end piece in the central body.

These stop means comprise a lug 8 provided on one of the side walls 12 of the central body or two lugs 8 each provided on a respective side wall 12 of the central body. As appears from FIG. 1, the lug 8 on the central body is disposed adjacent the mouth of the channel 10 at the lower portion thereof. A lug 11 provided on the end piece is pressed by the spring 7 against the lug 8 on the central body, preventing the end piece from being moved out of the central body.

FIGS. 2*a* and 2*b* illustrate two embodiments of the stop means. In FIG. 2*a*, a triangular lug 8 is provided on one side wall 12 of the central body. This lug has a guide edge 14 which, as seen from the mouth of the axial channel, extends inwardly towards the geometrical axis of the central body. The lug also has a stop edge 15 against which the lug 11 of the end piece is urged by the spring 7. As appears from FIG. 1, the stop edge of the lug on the central body extends slightly downwardly and towards the mouth of the channel 10. The corresponding surface of the end piece lug 11 is approximately parallel to the stop lug 15, providing a more reliable engagement between the lug 8 and the lug 11.

In FIG. 2*b*, there are shown two lugs 8 provided on each side wall 12 of the central body. Between the guide edges 14 of the lugs on the central body, there is defined an entrance channel 16 converging towards the central portion of the central body.

FIG. 3 shows another type of lug on the central body, which differs from that in FIG. 2*a* by the design of the stop edge 15. In this embodiment, the stop edge extends from the side wall 12 outwardly towards the mouth of the axial channel at an angle considerably less than 90° and is terminated by a curved portion forming an angle of approximately 90° with the side wall 12. In this embodiment, the movement of the end piece can be slowed up before the lug 11 comes into engagement with the outer curved portion of the stop edge 15, by riding on the initial inclined portion of the stop edge. By this design, the strength of the lug 8 on the central body can be further increased.

The function of the stop means 8, 11 will now be described with reference to the embodiment in FIG. 2*b*. When the insertion shank 4 of the end piece should be inserted in the axial channel 10, the lug 11 on the end piece is inserted in the channel 16 and will encounter the guide edges 14. Upon further insertion of the shank 4, the lugs 8 on the central body will be urged apart such that the gap between these lugs is widened. In this phase, the side walls 12 yield outwardly and, thus, take up the forces of deformation produced by the insertion of the shank 4 and acting on the central body. When the lug 11 on the end piece has passed the lugs 8 on the central body, the lugs 8 will snap in behind the end piece lug which is urged, by the spring 7 shown in FIG. 1, into abutment against the stop edges 15 of the lugs 8 on the central body.

I claim:

1. A clothes-hanger for skirts and trousers comprising a central body (1) having two flexible side walls (12) defining between them an axial channel (10) for accommodating at least one compression spring (7); an end piece (2) inserted in each end of the central body, and a hook (5) mounted on the central body, the displacement of the end piece by means of the compression spring out of the central body being restricted by stop means consisting of cooperating lugs (8, 11) at least one (8) of which is provided on the central body and at least one (11) of which is provided on the end piece, characterized in that the lug (8) on the central body is fixedly disposed on one of the side walls (12) thereof at a portion of said lug (8) extending parallel to the longitudinal axis of said central body, the lug (11) on the end piece, when inserting the end piece in the central body, being allowed to freely pass the lug on the central body by urging this lug and the side wall (12) of the central body outwardly, and the lug on the central body, after said passage of the end piece lug, snapping in behind this lug.

2. Clothes-hanger as claimed in claim 1, characterized in that the lug on the central body is projection (8) extending into the axial channel and having a guide edge 814) and a stop edge (15) for the lug on the end piece, the guide edge, as seen from the mouth of the channel, extending inwardly towards the geometrical axis of the central body and the stop edge being approximately at right angles to said geometrical axis.

3. The clothes hanger as claimed in claim 1 wherein two lugs (8) are each fixedly disposed on the central body and which are opposed each on a respective side wall of the central body.

4. A clothes hanger for skirts and trousers comprising a central body (1) having a hook (5) mounted thereon and having two flexible side walls (12) defining between them an axial channel (10) for accommodating at least one compression spring (7), an end piece (2) inserted in each end of the central body, the displacement of the end piece by means of the compression spring out of the central body being restricted by cooperating stop means provided on the central body and on the end piece; characterized in that said stop means comprises a lug (11) on the end piece and two lugs (8) each fixedly disposed on the central body and which are opposed each on a respective side wall of the central body and each having a stop edge (15) for the lug on the end piece and guide edges (14) which form an entrance channel (16) adapted to guide the lug on the end piece and which converges toward the central portion of the central body, said guide edges, as seen from the mouth of the channel, extending inwardly towards the geometrical axis of the central body and the stop edges being approximately at right angles to said geometrical axis of the central body, with the lug on the end piece, when inserting the end piece into the central body, being allowed to freely pass the lugs on the central body by urging these lugs and the side walls of the central body outwardly, and the lugs on the central body, after said passing of the end piece lug, snapping in behind this lug.

* * * * *

UNITED STATES PATENT AND TRADEMARK OFFICE

CERTIFICATE OF CORRECTION

PATENT NO. : 4,832,239

DATED : May 23, 1989

INVENTOR(S) : Ulf Andersson

It is certified that error appears in the above-identified patent and that said Letters Patent is hereby corrected as shown below:

IN THE CLAIMS:

Claim 2, col. 3, line 20, change "814)" to --(14)--.

Signed and Sealed this

Fourth Day of September, 1990

*Attest:*

*Attesting Officer*

HARRY F. MANBECK, JR.

*Commissioner of Patents and Trademarks*